US008608280B2

(12) United States Patent
Matsuhashi

(10) Patent No.: US 8,608,280 B2
(45) Date of Patent: Dec. 17, 2013

(54) RECORDING APPARATUS AND RECORDING METHOD

(75) Inventor: Kunihiko Matsuhashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/414,646

(22) Filed: Mar. 7, 2012

(65) Prior Publication Data

US 2012/0229566 A1 Sep. 13, 2012

(30) Foreign Application Priority Data

Mar. 8, 2011 (JP) ..... 2011-050195

(51) Int. Cl.
*B41J 23/00* (2006.01)

(52) U.S. Cl.
USPC ..... 347/37

(58) Field of Classification Search
USPC ..... 347/37
See application file for complete search history.

(56) References Cited

U.S. PATENT DOCUMENTS

| | | | | |
|---|---|---|---|---|
| 5,500,661 | A * | 3/1996 | Matsubara et al. | 347/41 |
| 5,815,282 | A * | 9/1998 | Kano | 358/296 |
| 6,130,685 | A * | 10/2000 | Matsubara et al. | 347/41 |
| 6,244,688 | B1 * | 6/2001 | Hickman | 347/43 |
| 6,705,717 | B1 * | 3/2004 | Fujita et al. | 347/106 |
| 2002/0105569 | A1 * | 8/2002 | Murcia et al. | 347/101 |
| 2003/0067527 | A1 | 4/2003 | Temple | |
| 2003/0202026 | A1 * | 10/2003 | Smith et al. | 347/12 |
| 2005/0035995 | A1 | 2/2005 | Yazawa et al. | |
| 2006/0158473 | A1 * | 7/2006 | Mills et al. | 347/15 |
| 2006/0158481 | A1 * | 7/2006 | Spevak et al. | 347/43 |
| 2009/0128599 | A1 * | 5/2009 | Puigardeu et al. | 347/37 |
| 2010/0143593 | A1 | 6/2010 | Sano | |

FOREIGN PATENT DOCUMENTS

| | | |
|---|---|---|
| JP | 2000-141708 | 5/2000 |
| JP | 2002-530229 | 9/2002 |
| JP | 2005-059363 | 3/2005 |
| JP | 2005-125662 | 5/2005 |
| JP | 4059629 | 12/2007 |
| JP | 2010-158884 | 7/2010 |
| WO | 00-30856 | 6/2000 |

* cited by examiner

*Primary Examiner* — Matthew Luu
*Assistant Examiner* — Alexander D Shenderov
(74) *Attorney, Agent, or Firm* — Workman Nydegger

(57) ABSTRACT

A recording apparatus includes: a recording head that discharges a recording ink and an undercoating ink on a recording medium; a driving section that drives at least one of the recording medium and the recording head so that the recording medium and the recording head are relatively scanned several times in one direction; and a control section that causes an undercoating layer with the undercoating ink on a predetermined area of the recording medium and a recording layer with the recording ink to be laminated by the recording head and the driving section, and simultaneously allows that the number of the scannings in a case where the undercoating ink is discharged with respect to the predetermined area is larger than the number of the scannings in a case where the recording ink is discharged with respect to the predetermined area.

4 Claims, 6 Drawing Sheets

RECORDING APPARATUS AND RECORDING METHOD

BACKGROUND

1. Technical Field

The present invention relates to a recording apparatus and a recording method.

2. Related Art

In the related art, as a printing apparatus that performs color printing with respect to a recording paper or the like, a printing apparatus by a ink jet method is used. On the other hand, JP-A-2010-158884 suggests a technique wherein in a printing apparatus that performs color printing with respect to a medium where color of an undercoat such as plastic product or metal product is not limited to white color in order not to affect the color of the undercoat, after white color of the undercoat layer is formed with respect to a printed surface of a medium, ink droplets of each color are discharged from a recording head of ink jet type and color printing is performed on the undercoating layer.

However, in the above described configuration, stain may occur at the undercoating layer. When the stain occurs at the undercoating layer, recording quality is decreased.

SUMMARY

An advantage of some aspects of the invention is that it provides a recording apparatus and a recording method that may secure recording quality.

According to an aspect of the invention, there is provided a recording apparatus which includes a recording head that discharges a recording ink and an undercoating ink on a recording medium; a driving section that drives at least one of the recording medium and the recording head so that the recording medium and the recording head are relatively scanned several times in one direction; and a control section that causes the recording ink to be overlapped and discharged on a predetermined area of the recording medium after the undercoating ink is discharged with respect to the predetermined area using the recording head and the driving section, and simultaneously allows that the number of the scannings in a case where the undercoating ink is discharged with respect to the predetermined area is larger than the number of the scannings in a case where the recording ink is discharged with respect to the predetermined area.

According to the aspect of the invention, the recording ink is overlapped and discharged at the predetermined area of the recording medium after the undercoating ink is discharged with respect to the predetermined area using the recording head and the driving section, and simultaneously the number of the scannings in a case where the undercoating ink is discharged with respect to the predetermined area is larger than the number of the scannings in a case where the recording ink is discharged with respect to the predetermined area so that the size of each of ink droplets or the number of the ink droplets that are discharged per an unit area of the recording medium with the scanning of one time can be small compared to a case that the number of the scannings in a case where the undercoating ink is discharged with respect to the predetermined area is the same as the number of the scannings in a case where the recording ink is discharged. Thus, ink dots of the undercoating ink that are formed on the recording medium can be in an appropriate drying state and the recording quality can be secured.

It is preferable that the recording apparatus use one or more color inks as the recording ink and the recording head have a recording nozzle that discharges the recording ink and an undercoating nozzle that discharges the undercoating ink, and the number of the undercoating nozzles be larger than the number of the recording nozzles of each one color respectively.

According to the aspect of the invention, one or more color inks are used as the recording ink, the recording head has the recording nozzles that discharge the recording ink and the undercoating nozzles that discharge the undercoating ink, and the number of the undercoating nozzles is larger than the number of the recording nozzles of each one color respectively so that the number of the discharging dots of the undercoating ink can be larger than the number of the discharging dots of the recording ink in the scanning of one time. Otherwise, the discharging amount of the undercoating ink in one undercoating nozzle can be small than the discharging amount of the recording ink in one recording nozzle. Thus, the undercoating ink may be effectively discharged so that the formation speed of the undercoating layer may be secured.

It is preferable that the recording apparatus further include a transportation section that transports the recording medium in a second direction that is orthogonal to one direction, and the number of the undercoating nozzles in the transportation direction of the recording medium be larger than the number of the recording nozzles of each one color in the transportation direction respectively.

According to the aspect of the invention, the transportation section that transports the recording medium in a second direction that is orthogonal to one direction is further included and the number of the undercoating nozzles in the transportation direction of the recording medium is larger than the number of the recording nozzles of each one color in the transportation direction respectively so that discharging of the undercoating ink can be discharged in a wider area. Thus, stain of the undercoating ink can be decreased.

According to another aspect of the invention, there is provided a recording method which includes laminating an undercoating ink and a recording ink in which the recording ink is overlapped and discharged on a predetermined area of a recording medium after the undercoating ink is discharged with respect to the predetermined area by a recording head while the recording medium and the recording head that discharges the recording ink and the undercoating ink at the recording medium are relatively scanned several times in one direction; and adjusting the number of scannings such that the number of the scanning in a case where the undercoating ink is discharged with respect to the predetermined area is larger than the number of the scannings in a case where the recording ink is discharged with respect to the predetermined area in the laminating of the undercoating ink and the recording ink.

According to the aspect of the invention, the recording ink is overlapped and discharged on the predetermined area after the undercoating ink is discharged with respect to the predetermined area of the recording medium and the number of scannings in a case where the undercoating ink is discharged with respect to the predetermined area is larger than the number of the scannings in a case where the recording ink is discharged with respect to the predetermined area so that the undercoating ink can be formed thick compared to the recording ink. Thus, occurrence of stain in the undercoating ink can be suppressed so that the recording quality can be secured.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings.

Figure 1:
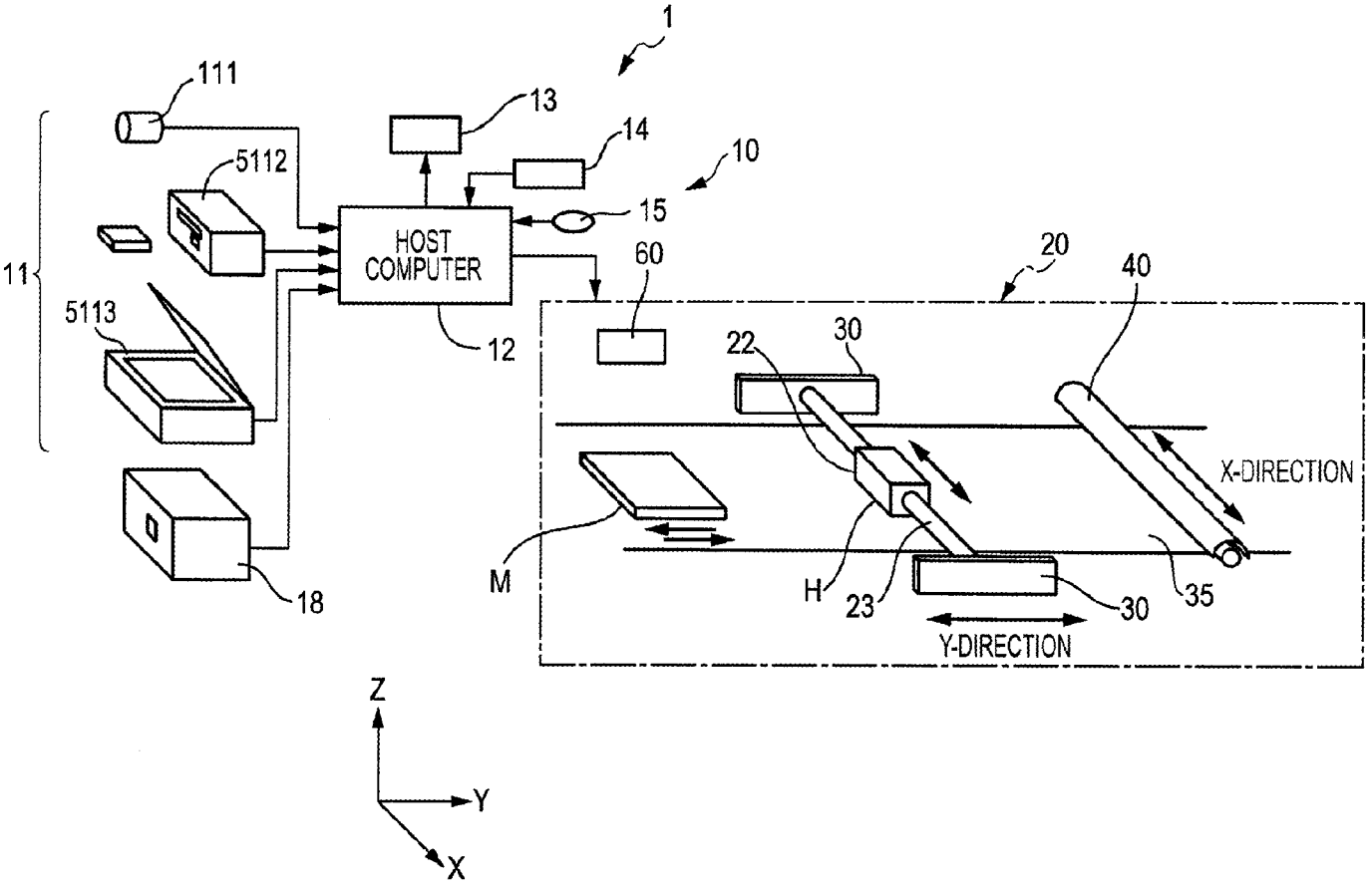
FIG. 1 is a view illustrating a configuration of a color printing apparatus according to an embodiment of the invention.

FIG. 1 is a configuration view schematically illustrating a color printing apparatus of the embodiment.

In FIG. 1, the color printing apparatus 1 is generally configured of a data input system 10 that performs input of print content or the like with respect to a medium M that is a print target and a main body 20 of the color printing apparatus that performs full color print with respect to the medium M. Here, a printed surface (an upper surface) of the medium M is configured of a material such as plastic product or metal product that has low absorption property of ink. More specifically, materials such as OPP, CPP, nylon, polyimide, PET, aluminum or vinyl chloride are exemplified.

The data input system 10 is configured of an imaging device 111, a disk driving device 5112 and a scanner 5113, as an input device 11 in order for a user to input data of desired color design. The color design image data with respect to a host computer 12 is output from the input device 11.

The host computer 12 displays an image screen on a monitor 13 based on the color design image data that is input from the input device 11 and an user who saw the image screen instructs edition such as increasing, decreasing and cutting-and-pasting of the image screen through a key board 14 or a mouse 15. In addition, the host computer 12 performs a gradation process, a contrast process, a color calibration or the like with respect to the edited color design image data, if required; performs a calibration process of the image along a concavo-convex of the printed surface of a medium M in order to increase print quality; and then outputs an output image data to a control section 60 of the main body 20 of the color printing apparatus.

First, in the main body 20 of the color printing apparatus, a recording head H for the color print is capable of reciprocating in an axial direction (a main scanning direction/a X-axis direction) through a carriage 22 on a guide shaft 23. The recording head H is configured such that a discharging direction of ink is set to a lower direction.

Figure 2:
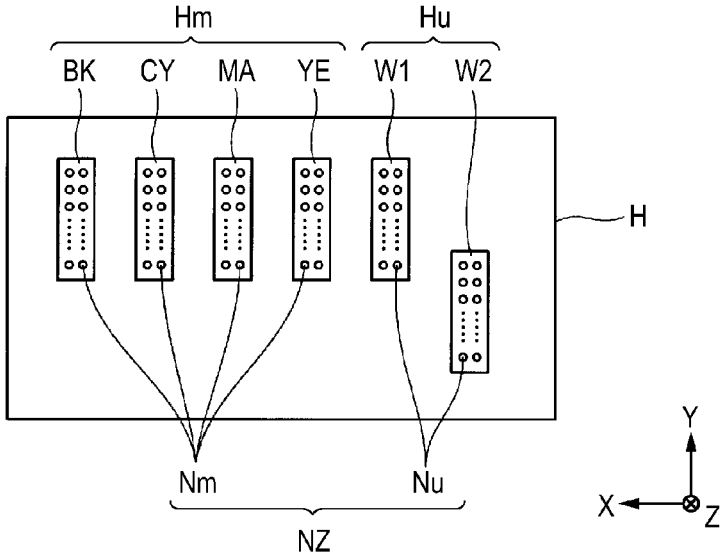
FIG. 2 is a bottom view illustrating a configuration of a head of a color printing apparatus according to the embodiment.

FIG. 2 is a bottom view illustrating configuration of the recording head H.

As shown in FIG. 2, the recording head H has a recording ink discharging section Hm that discharges the recording ink and an undercoating ink discharging section Hu that discharges the undercoating ink.

The recording ink discharging section Hm is provided with discharging sections BK, CY, MA and YE that discharge ink of each color of black, cyan, magenta and yellow. Each of the discharging sections BK, CY, MA and YE is provided with the recording nozzles Nm that discharge the recording ink.

The undercoating ink discharging section Hu is provided with discharging sections W1 and W2 that discharge the undercoating ink of white color. Each of the discharging sections W1 and W2 is provided with undercoating nozzles Nu that discharges the undercoating ink. Hereinafter, in a case where the recording nozzle Nm and the undercoating nozzle Nu are written together, it is referred to as nozzles NZ.

The number of the nozzles NZ provided at each of the discharging sections BK, CY, MA, YE, W1 and W2 are the same each other respectively. Thus, the total number of the nozzles (the total number of the undercoating nozzles Nu) of the discharging sections W1 and W2 is large compared to the number of the recording nozzles Nm of each color of the discharging sections BK, CY, MA and YE respectively.

The discharging section W1 and the discharging section W2 are arranged in deviated positions in a transportation direction (a Y-direction) of the medium M. Thus, the number of the undercoating nozzles Nu is larger than the number of the recording nozzles Nm that are provided at each of the discharging sections BK, CY, MA and YE in the transportation direction (the Y-direction) of the medium M.

Figure 3:
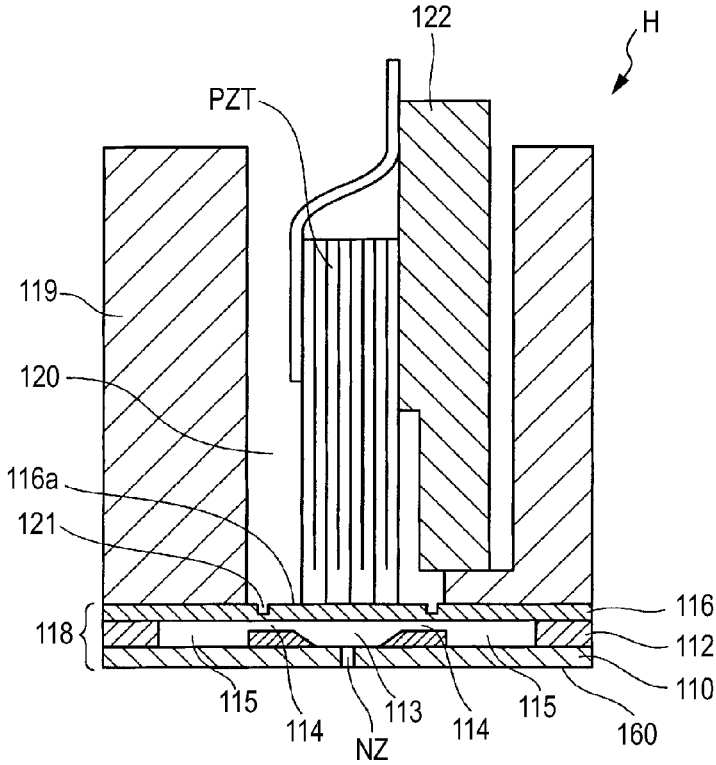
FIG. 3 is a cross-sectional view illustrating a configuration of a head according to the embodiment.

FIG. 3 is a cross-sectional view illustrating a configuration of the recording head H.

As shown in FIG. 3, the recording head H has a nozzle plate 110 and a flow passage forming plate 112. The nozzle plate 110 forms the nozzle NZ. The flow passage forming plate 112 forms a through hole that comparts a pressure generation chamber 113, a through hole or a groove that comparts two ink supply ports 114 that communicate to both sides of the pressure generation chamber 113, and a through hole that comparts two common ink chambers 115 that communicate to the ink supply ports 114 respectively. A vibration plate 116 is configured of a sheet plate capable of elastically deforming; contacts an end of a piezoelectric vibrator PZT (a pressure generation element) such as a piezo element; is fixed fluid-tightly and integrally with the nozzle plate 110 having the flow passage forming plate 112 pinched therebetween; and configures a flow passage unit 118.

A base die 119 is configured of an accommodating chamber 120 that vibratably accommodates the piezoelectric vibrator PZT and an opening 121 that supports the flow passage unit 118, and fixes the piezoelectric vibrator PZT at a fixing substrate 122 in a state where the end of the piezoelectric vibrator PZT is exposed from the opening 121. In addition, the base die 119 fixes the flow passage unit 118 to the opening 121 and arranges the recording head 16 in a state where an island section 116*a* of the vibration plate 116 is made to contact the piezoelectric vibrator PZT.

According to the above described configuration, when the piezoelectric vibrator PZT contracts and the pressure generation chamber 113 expands, ink in the common ink chambers 115 flows in the pressure generation chamber 113 through the ink supply port 114. After a predetermined time is lapsed, when the piezoelectric vibrator PZT extends and then the pressure generation chamber 113 contracts, ink in the pressure generation chamber 113 is compressed and then ink droplets are discharged from the nozzles NZ. The discharging of the ink droplets is also similar to the nozzles NZ for discharging of any one of color inks.

Both ends of a guide shaft 23 that supports a carriage 22 is supported by a frame 30 and the frame 30 is capable of moving in the Y-axis direction (a sub-canning direction). As described above, the frame 30 moves in the Y-axis direction, simultaneously, each carriage 22 moves on the guide shaft 23 in the X-direction so that a moving mechanism that performs a relative movement of the recording head H and the medium M is configured.

A medium transportation device 35 that transports the medium M in Y-axis direction is configured at a position of −Z side of the recording head H. The medium transportation device 35 is configured of a holder (not shown) or the like that receives the medium M pulled out from a medium storage section (not shown) and the holder holds the medium M in a state where printed surface thereof is in upper direction. A dryer 40 is arranged near the medium transportation device 35.

Figure 4:
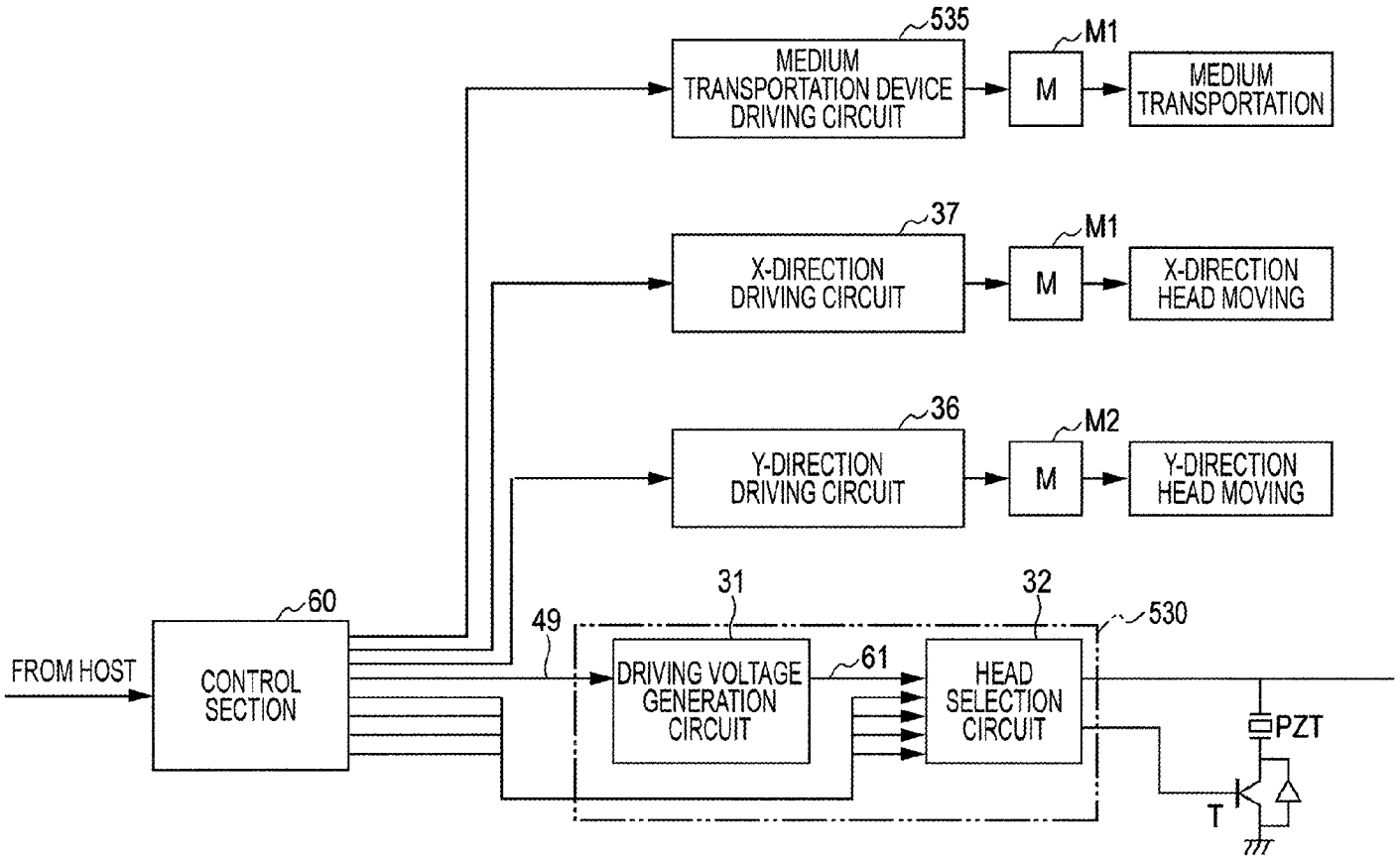
FIG. 4 is a block diagram illustrating a configuration of a control section according to the embodiment.

A configuration of a control system that is included in the main body 20 of the color printing apparatus will be described with reference to FIG. 4. First, in FIG. 4, in order to perform a predetermined print with respect to the medium M, the control section 60 that is included in the main body 20 of the color printing apparatus receives a printing instruction signal or printing data from the host computer 12, controls a recording head driving circuit 530 including a driving voltage generation circuit 31 and a head selection circuit 32, and simultaneously also controls a carriage driving circuit 33 or the like so that the printing operation is performed. In other words, in the head driving circuit 530, the driving voltage generation circuit 31 is configured such that a trapezoid wave of a voltage value required to discharge the ink droplets from the nozzles NZ is generated. In addition, the head selection circuit 32 controls a transistor T so that a driving voltage of the driving voltage generation circuit 31 is selectively applied to the piezoelectric vibrator PZT corresponding to the printing data.

In the embodiment, the control section 60 controls a motor M1 that drives the medium transportation device 35 through a medium transportation device driving circuit 535 and controls the transportation of the medium M in the Y-axis direction in the medium transportation device 35 with reference to FIG. 1. In addition, the control section 60 controls a motor M2 that drives the frame 30 through a Y-axis driving circuit 36 in the Y-axis direction and controls a positional relation of the medium M and the carriage 22 in the Y-axis direction. Furthermore, the control section 60 controls a motor M3 that drives the carriage 22 on the guide shaft 23 through an X-axis driving circuit 37 and controls a positional relation between the medium M and the carriage 22 in the X-axis direction.

Figure 5A:
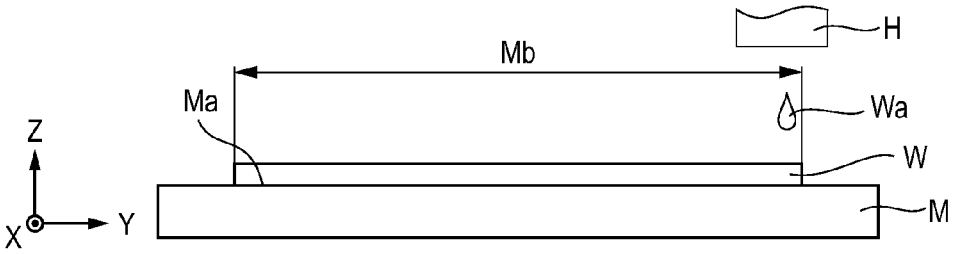
FIGS. 5A and 5B are views illustrating a printing operation of a color printing apparatus according to the embodiment.
Figure 5B:
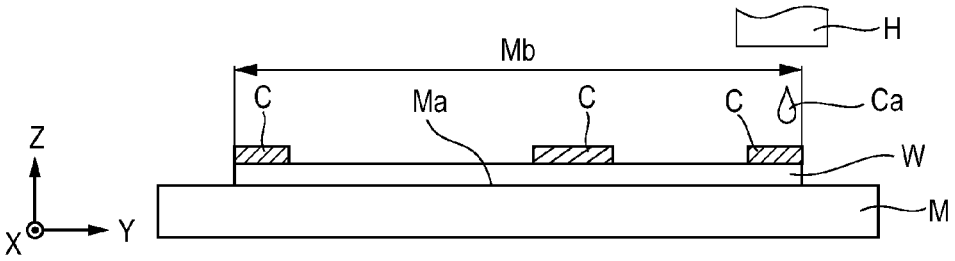

Operation of the above described color printing apparatus 1 will be described with reference to FIGS. 5A and 5B. FIGS. 5A and 5B are cross-sectional views illustrating a process of performing the print on the printed surface of the medium M.

For example, in a case where the operation of performing the print is practiced by the user, the control section 60 pulls out the medium at the medium storage section and receives it in the medium transportation device 35. The control section 60 transports the medium M to a position of −Z side of the carriage 22 with the medium transportation device 35.

In this state, as shown in FIG. 5A, when the printing instruction is output to the main body 20 of the color printing apparatus from the host computer 12, the control section 60 scans the carriage 22 several times, for example, in the embodiment, 8 times from the end of +X side to the end of −X side of the medium M in the X-direction along the guide shaft 23 so as to discharge the undercoating ink Wa from the undercoating nozzle Nu, while relatively scanning the carriage 22 between the recording head H and the medium M. According to the operation, the undercoating layer W of the white color is formed at the printed surface Ma of the medium M. The control section 60 performs the discharging while moving the medium M in the Y-direction if required.

After the undercoating layer W is formed, the control section 60 is on standby in a predetermined time period and dries the undercoating ink Wa. After a predetermined time is lapsed, the control section 60 moves the medium M so as to be returned in −Y-direction by the medium transportation device 35 and the end of −Y side of the undercoating layer W is arranged in −Z side of the carriage 22.

After that, as shown in FIG. 5B, the control section 60 straightly moves the carriage 22 several times, for example, in the embodiment, 4 times from the end of +X side to the end of −X side of the medium M in the X-direction along the guide shaft 23 so as to overlap and discharge the recording ink Ca on the undercoating layer W from the recording nozzle Nm, while relatively scanning the carriage 22 between the recording head H and the medium M. According to the operation, the recording layer C is formed on the undercoating layer W from the recording nozzle Nm of the recording head H. The control section 60 performs the discharging while moving the medium M in the Y-direction if required (hereinabove, laminating the undercoating ink and the recording ink).

When the undercoating ink and the recording ink are discharged, the control section 60 allows that the number of the scannings in a case where the undercoating ink is discharged to a printing area Mb on the printed surface Ma of the medium M is larger than the number of the scannings in a case where the recording ink is discharged (adjusting the number of the scannings). According to the operation, the undercoating layer W that is a foundation of the recording layer C is formed without stain so that the recording layer C may be stably formed.

When the above described operation of formation of the recording layer C is finished, the control section 60 moves the medium M in +Y direction using the medium transportation device 35 and discharges the medium M. In addition, the control section 60 may dry the undercoating layer W or the recording layer C using the dryer 40, if required in the above described operation. After that, the control section 60 returns the color printing apparatus 1 to the standby state.

As described above, according to the embodiment, after the undercoating ink Wa is discharged with respect to the printing area Mb of the medium M using the recording head H and the motor M3, the recording ink Ca is overlapped and discharged on the printing area Mb and the number of the scannings in a case where the undercoating ink Wa is discharged at the printing area Mb is larger than the number of the scannings in a case where the recording ink Ca is discharged with respect to the printing area Mb. Thus, the ink droplets or the number of the ink droplets of the undercoating ink Wa that is discharged per unit area of the recording medium with one time scanning may be decreased compared to the same number of scannings in a case where the recording ink Ca is discharged. Accordingly, ink dots of the undercoating ink Wa that is formed on the recording medium is in a state of evenly and appropriately dried without the ink dots being connected to each other, and occurrence of stain may be suppressed at the undercoating layer W so that the recording quality may be secured.

In addition, according to the embodiment, one or more color inks are used as the recording ink Ca, the recording head H has the recording nozzle Nm that discharges the recording ink Ca and the undercoating nozzle Nu that discharges the undercoating ink Wa, and the number of the undercoating nozzles Nu is larger than number of the recording nozzles Nm each one color respectively so that an discharging amount of the undercoating ink Wa may be large compared to an discharging amount of the recording ink Ca in one scanning. Otherwise, the discharging amount of the undercoating ink Wa that is discharged from one undercoating nozzle Nu may be smaller than the discharging amount of the recording ink Ca that is discharged from one recording nozzle Nm. Accordingly, the undercoating ink Wa may be effectively discharged so that a formation speed of the undercoating layer W may be secured.

A technical range of the invention is not limited to the above described embodiment and appropriate change may be added to a range that does not depart from the gist of the invention.

For example, in the above described embodiment, the invention is configured such that one recording head H is scanned so that the undercoating layer W and the recording layer C are formed on the medium M, however the invention is not limited to the embodiment. For example, as shown in FIG. 6, a plurality of heads may be configured in a line in the transportation direction (the Y-direction) of the medium M.

Figure 6:
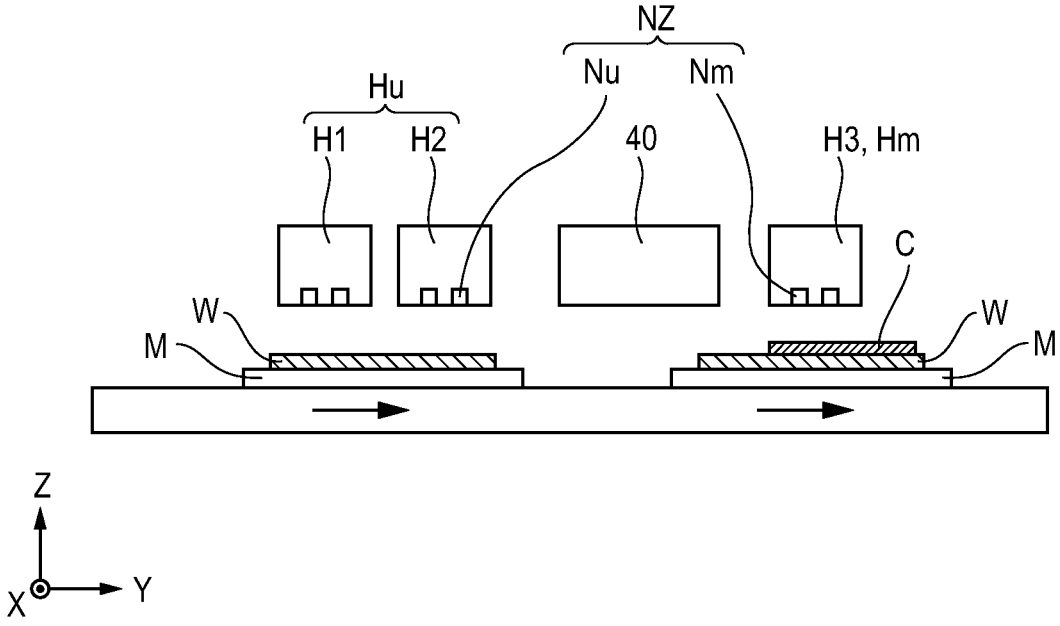
FIG. 6 is a view illustrating another embodiment of a color printing apparatus according to the embodiment.

In the configuration illustrated in FIG. 6, a first head H1, a second head H2 and a third head H3 are arranged from −Y side to +Y side. The dryer 40 is arranged between the second head H2 and the third head H3. The first head H1 and the second head H2 are arranged as the undercoating ink discharging section Hu that discharges the undercoating ink. In addition, the third head H3 is arranged as the recording ink discharging section Hm that discharges the recording ink.

In addition, the nozzles NZ are arranged with the same number at the first head H1, the second head H2 and the third head H3. In this case, the number of the undercoating nozzles Nu that discharge the undercoating ink is larger than the number of the recording nozzles Nm that discharge the recording ink. Accordingly, the undercoating layer may be graciously formed so that the recording quality may be secured.

In addition, in the above described embodiment, the configuration where the medium M is transported in one direction (+Y direction) is exemplified, however the invention is not limited to the embodiment. For example, as described below, a configuration where the medium M is transported in a plurality of directions may be used.

Figure 7:
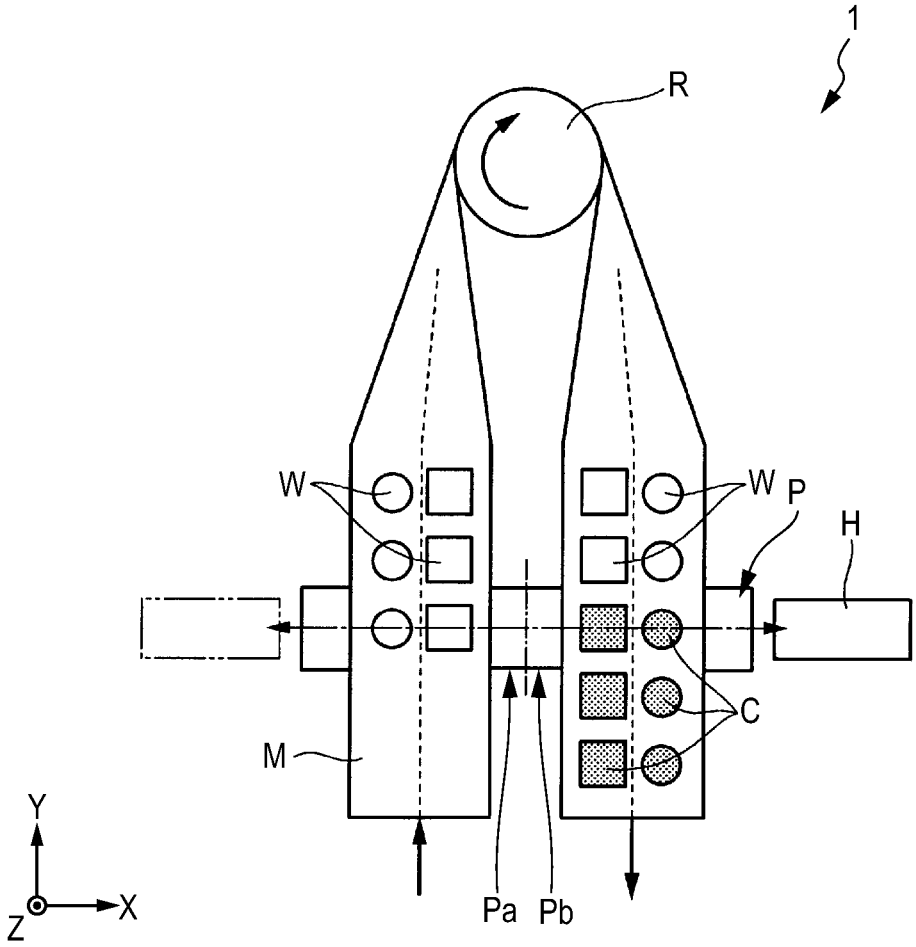
FIG. 7 is a view illustrating another embodiment of a color printing apparatus according to the embodiment.

FIG. 7 is a view illustrating another configuration of the color printing apparatus 1.

As shown in FIG. 7, the color printing apparatus 1 has a transportation roller R that transports the medium M that is formed in a band shape. The transportation roller R is arranged in +Y side of a medium support section P. The medium support section P is arranged in −Z side of the scanning area of the recording head H and is a portion that supports the medium M.

In the configuration, the medium M is brought in from −Y side of the color printing apparatus 1 and is supported at a first support area Pa that is arranged in −X side of the medium support section P. When the medium M is arranged at the first support area Pa, the control section discharges the undercoating ink from the undercoating nozzle while scanning the recording head H in a plurality of times (for example, 8 times) in the X-direction and therefore the undercoating layer W is formed at the medium M.

The control section transports the medium M to the transportation roller R, on which the undercoating layer W is formed using the medium transportation device. The medium M reached at the transportation roller R, returns to −Y side at the transportation roller R. The returned medium M is supported at a second support area Pb that is arranged at half portion in +X side of the medium support section P. When the medium M is arranged at the second support area Pb, the control section overlaps and discharges the recording ink on the undercoating layer W from the recording nozzle, while scanning the recording head H a plurality of times (for example, 4 times) in the X-direction, and therefore the recording layer C is formed on the undercoating layer W.

Even in this case, when the undercoating ink and the recording ink are discharged, the control section allows that the number of the scannings in a case where the undercoating ink is discharged is larger than the number of the scannings in a case where the recording ink is discharged.

In operation after that, for example, after the undercoating layer W is formed at the medium M that is arranged at the first support area Pa, the control section may form the recording layer C on the undercoating layer W of the medium M arranged at the second support area Pb, using a time when the undercoating layer W is dried. Accordingly, effective recording operation may be performed.

In the above described embodiment, the recording apparatus that employs the ink jet type as the recording type is described, however, it may also be changed to any type of recording apparatus such as an electrophotographic type or a heat transfer type. In addition, the recording apparatus is not limited to the printing apparatus, and the recording apparatus may be a facsimile, a copy device or a multifunction machine having a multifunction thereof. Furthermore, as the recording apparatus, a liquid ejecting device including a liquid ejecting head or the like where a minimal amount of liquid droplets of other liquid besides ink is ejected or discharged may be employed.

In addition, the liquid droplet is a state of liquid that is discharged from the liquid ejecting device and also includes liquid that is dragged in granule, teardrop and thread shape. In addition, liquid referred in the specification may be material that is ejected from the liquid ejecting device. For example, the material may be good if the material is liquid phase. Flow state such as liquid shape material where the viscosity thereof is high or low, sol, gel, inorganic solvent for that, organic solvent, solution, resin of liquid shape and metal of liquid shape (metal melt), and not only liquid as a state of material but also a material where particle of functional material that is configured of solid matter such as pigment or metal particle is dissolved, dispersed or mixed in solvent are also included. In addition, ink that is described in the above described embodiment or liquid crystal is exemplified as a representative example of liquid.

Here, ink includes various liquid compositions such as general water-based ink, oil-based ink, gel ink, and hot melt ink. As specific examples of the liquid ejecting device, for example, liquid crystal display, EL (electroluminescence) display, surface emitting display, liquid ejecting device that ejects liquid including materials in a manner of dispersing or dissolving materials such as electrode material or color material that is used in manufacturing of color filter, textile printing device or the like may be used.

The entire disclosure of Japanese Patent Application No. 2011-050195, filed Mar. 8, 2011 is expressly incorporated by reference herein.

What is claimed is:

1. A recording apparatus comprising:

a recording head that discharges a recording ink and an undercoating ink on a recording medium;

a driving section that drives at least one of the recording medium and the recording head so that the recording medium and the recording head are relatively scanned several times in one direction; and a control section that uses the recording head and the driving section to cause the recording ink to be discharged on a predetermined area of the recording medium after the undercoating ink is discharged onto the predetermined area, wherein the recording ink overlaps the undercoating ink, and wherein the number of the scannings when the undercoating ink is discharged onto the predetermined area is larger than the number of the scannings when the recording ink is discharged onto the predetermined area.

2. The recording apparatus according to claim 1, wherein one or more color inks are used as the recording ink, the recording head has recording nozzles that discharge the recording ink and undercoating nozzles that discharge the undercoating ink, and the number of the undercoating nozzles is larger than the number of the recording nozzles of each one color respectively.

3. The recording apparatus according to claim 2, further including a transportation section that transports the recording medium in a second direction that is orthogonal to the one direction, and wherein the number of the undercoating nozzles in the transportation direction of the recording medium is larger than the number of the recording nozzles each one color in the transportation direction respectively.

4. A recording method comprising:

laminating an undercoating ink and a recording ink in which the recording ink is overlapped and discharged on a predetermined area of a recording medium after the undercoating ink is discharged with respect to the predetermined area by a recording head while the recording medium and the recording head that discharges the recording ink and the undercoating ink at the recording medium are relatively scanned several times in one direction; and adjusting the number of scannings such that the number of the scanning in a case where the undercoating ink is discharged with respect to the predetermined area is larger than the number of the scannings in a case where the recording ink is discharged with respect to the predetermined area in the laminating of the undercoating ink and the recording ink.

* * * * *